US005465597A

United States Patent [19]

Bajraszewski et al.

[11] Patent Number: 5,465,597

[45] Date of Patent: Nov. 14, 1995

[54] EXTRUSION FORMING OF INTERNAL HELICAL SPLINES

[75] Inventors: Alexander Bajraszewski, Richmond; David H. Dodds, South Lyon; Charles E. Muessig, Novi; Vijay Nagpal, Westland, all of Mich.

[73] Assignee: Ford Motor Company, Dearborn, Mich.

[21] Appl. No.: 276,590

[22] Filed: Jul. 18, 1994

[51] Int. Cl.[6] ..... B21K 1/30

[52] U.S. Cl. ..... 72/19; 72/117; 72/355.4; 29/893.34

[58] Field of Search ..... 72/19, 117, 343, 72/352, 355.4, 358, 359; 29/893.34; 74/441

[56] References Cited

U.S. PATENT DOCUMENTS

| | | | |
|---|---|---|---|
| 1,142,419 | 6/1915 | Hansen | 72/355.4 |
| 2,997,969 | 8/1961 | Holmes, Jr. | 72/456 |
| 3,186,210 | 6/1965 | Lesher et al. . | |
| 3,583,190 | 6/1971 | Wildhaber | 72/102 |
| 3,910,091 | 10/1975 | Samanta . | |
| 4,287,749 | 9/1981 | Bachrach et al. . | |
| 4,350,865 | 9/1982 | Backrach . | |
| 4,449,417 | 5/1984 | Sasaki | 74/441 |
| 4,452,060 | 6/1984 | Kanamaru et al. | 72/117 |
| 4,622,842 | 11/1986 | Bachrach et al. . | |
| 4,878,370 | 11/1989 | Fuhrman et al. . | |
| 5,052,210 | 10/1991 | Hoge . | |
| 5,247,819 | 9/1993 | Morimoto et al. | 72/19 |
| 5,325,698 | 7/1994 | Nagpal et al. . | |

*Primary Examiner*—Lowell A. Larson
*Attorney, Agent, or Firm*—Donald W. Wilkinson; Roger L. May

[57] ABSTRACT

An extrusion assembly, which fits into a hydraulic press, includes an upper die plate and a lower die plate mounted to one another by die guide posts. A lead bar is coupled to upper die plate at one end and a hydraulic chuck at its other end and includes helical grooves on its surface that mate with helical protrusions on lead nuts. Hydraulic chuck selectively retains a mandrel assembly. A die shell and insert are mounted concentrically with mandrel assembly and receive a gear blank. A bottom rest assembly is located below die shell and is positioned to receive mandrel assembly. An ejection assembly is positioned between bottom rest assembly and a hydraulic cylinder and includes ejector pins. As hydraulic press pushes lead bar axially through gear blank, lead nuts impart a rotational motion to lead bar, which causes mandrel to move with a helical motion as it is pressed into and through gear blank. Chuck then releases mandrel assembly onto bottom rest assembly and lead bar is retracted. Hydraulic cylinder pushes up on ejection assembly, causing ejector pins to eject the finished gear. Chuck is then lowered to re-attach to mandrel assembly.

18 Claims, 3 Drawing Sheets

EXTRUSION FORMING OF INTERNAL HELICAL SPLINES

FIELD OF THE INVENTION

The present invention relates to the forming of internal helical gear teeth, and more particularly to the use of cold extrusion for forming a ring gear having internal helical teeth.

BACKGROUND OF THE INVENTION

Complex gear trains often use ring gears having internal teeth. Some of these gear trains, such as those used in automotive transmissions and the like, advantageously use helical gears rather than straight gears even though helical gear teeth are more difficult to form. Additionally, in many of these instances the internal gear teeth must be formed with very precise dimensions and spacing in order to perform adequately. Consequently the need arises to be able to fabricate ring gears having internal helical teeth that are precisely formed.

One such method for precisely forming these helical teeth is broaching, which is a cutting process. In broaching, a large broaching bar with cutting teeth is pulled through a gear blank to form the teeth. Broaching has drawbacks, however, in that it is an expensive process which requires a significant investment in expensive machinery and cutting tools. For example, a broaching bar that is used to form an internal helical ring gear for an automotive transmission may have to be as much as eight feet long, which is expensive to fabricate. Further, broaching is not easy to automate since the broach bar is so long and must be pulled all of the way through the inside of the gear blank to cut the teeth, making it an expensive process to form internal helical gear teeth.

Gear shaping is another cutting process that can be used to fabricate internal helical teeth. However, it is a slower process than broaching and also requires an investment in expensive machinery and cutting tools, making it an even more expensive process.

A process for the forming of internal helical gear teeth that is faster than shaping and broaching and requires much less expensive tooling is cold extrusion. Cold extrusion is a process where gear teeth are formed into a part rather than cut into a part. A process for extruding internal teeth in a ring gear is disclosed in U.S. Pat. No. 4,878,370 to Fuhrman et al. The process disclosed therein is a two step process in which an annular work piece is advanced part of the way across external die teeth of a floating mandrel, and then a second work piece is inserted and used to push the first work piece through as the second one begins to be formed. Since each succeeding work piece is used to push the preceding work piece around the floating mandrel, this would not be an easy process to fully automate. Further, if helical teeth are being formed with the process disclosed in this patent, there is no external helical guidance while the teeth are being formed; only the helix of the die teeth are used to cause helical rotation of the work piece. This type of directional rotation will cause the amount of force that a hydraulic press must apply to extrude the work piece around the die teeth to increase since large friction forces will occur as the work piece slides along the annular inner surface of the die ring, thus requiring a larger, more expensive press.

The need arises, then, when one desires to precisely form internal helical teeth in a gear blank to be able to extrude the gear teeth in a cost efficient manner, which generally requires automating the extrusion process to increase the speed of operation and reduce the manpower required in performing the process.

SUMMARY OF THE INVENTION

In its embodiments, the present invention contemplates an apparatus for extrusion forming internal helical teeth in a through end gear blank. The apparatus includes a press, having a first member and a base, with the first member coupled to and axially movable relative to the base. The apparatus further includes a lead bar coupled to the first member having an outer surface which includes helical guides, and a mandrel assembly having an outer surface which includes helical die teeth for forming the internal helical teeth. A chuck means is coupled to the lead bar for removably coupling the mandrel assembly to the chuck means. A lead nut assembly is mounted to the press having helical guides operatively engaging the helical guides on the lead bar, and a die is mounted to the base which includes a cavity concentrically located relative to the mandrel assembly that is adapted to receive the gear blank. The apparatus further includes a means for receiving the mandrel assembly when it is not coupled to the chuck, and an ejection means for ejecting the finished gear from the die.

The present invention further contemplates a method of extrusion forming internal helical teeth in a through end gear blank having a bore therethrough. The method comprises the steps of providing a die base assembly adapted for receiving and aligning the gear blank; providing a lead bar concentrically located relative to the die base assembly; providing an extrusion mandrel assembly having helical die teeth on its external surface; providing a chuck, coupled to the lead bar, releasably attached to the mandrel assembly; placing the gear blank in the die base; moving the mandrel assembly axially into the bore of the gear blank while rotating the mandrel assembly until the mandrel assembly passes through the gear blank so as to extrude internal helical teeth in the gear blank, thereby forming an internal helical gear; stopping movement of the mandrel assembly; releasing the mandrel assembly from the chuck; pulling the lead bar axially out of the gear; ejecting the internal helical gear from the die base; and re-attaching the mandrel assembly to the chuck.

Accordingly, an object of the present invention is to form internal helical teeth in a through end gear blank without having to use an expensive metal cutting process, while precisely controlling the helical rotation of the mandrel as it is pressed through the gear blank, without requiring the mandrel to be pulled back through the formed gear.

An advantage of the present invention is a cost reduction in forming gears having internal helical teeth over conventional cutting methods.

A further advantage of the present invention is the precision with which a helical mandrel can be pushed through a gear blank when a helical motion is imparted to the mandrel during the gear tooth extrusion process.

A further advantage of the present invention is that the gear teeth forming process can be automated to reduce the overall cost of operation.

DETAILED DESCRIPTION OF THE PREFERRED EMBODIMENTS

Figure 1:
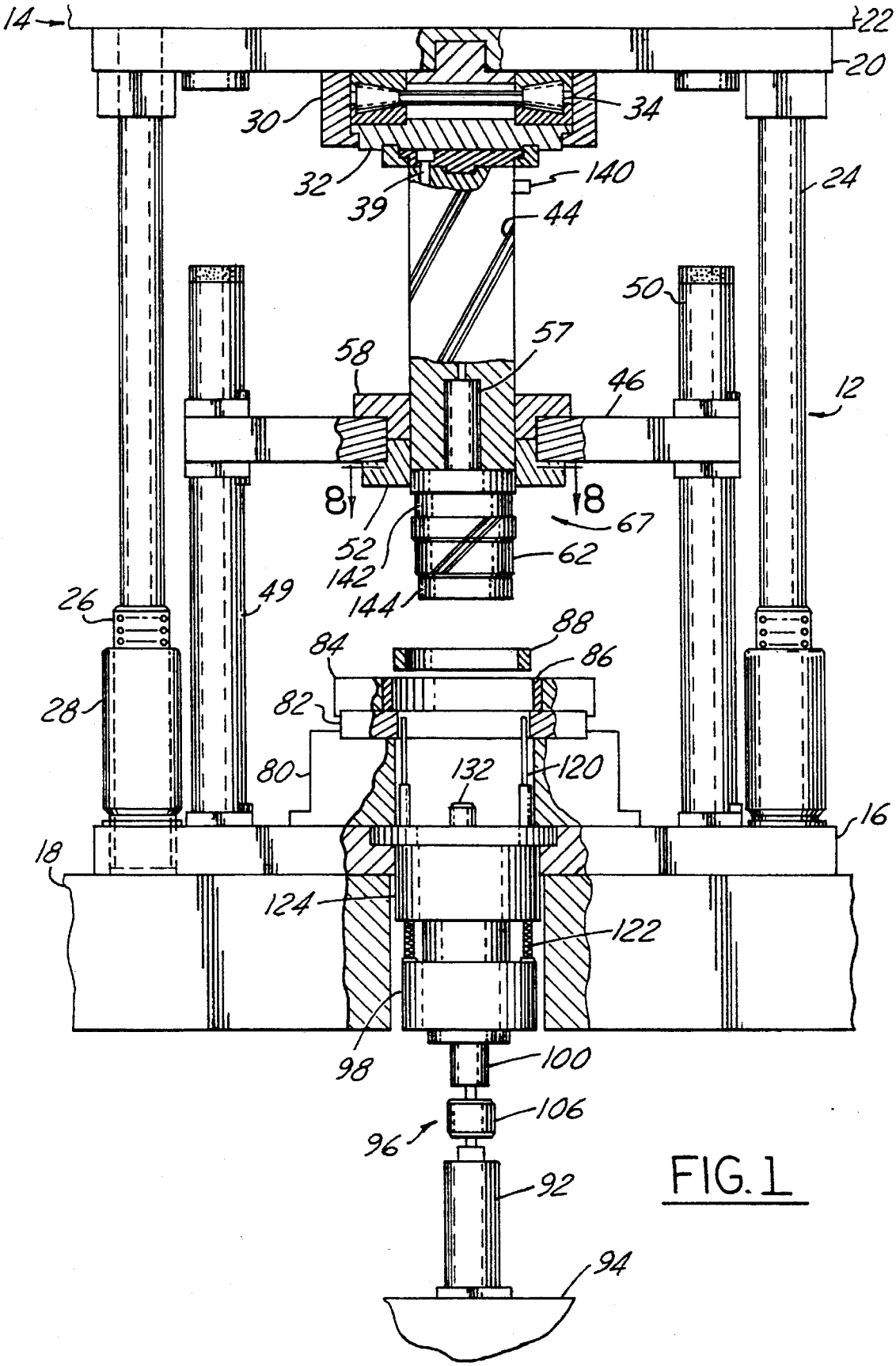
FIG. 1 is a side view of an extrusion press.
Figure 2:
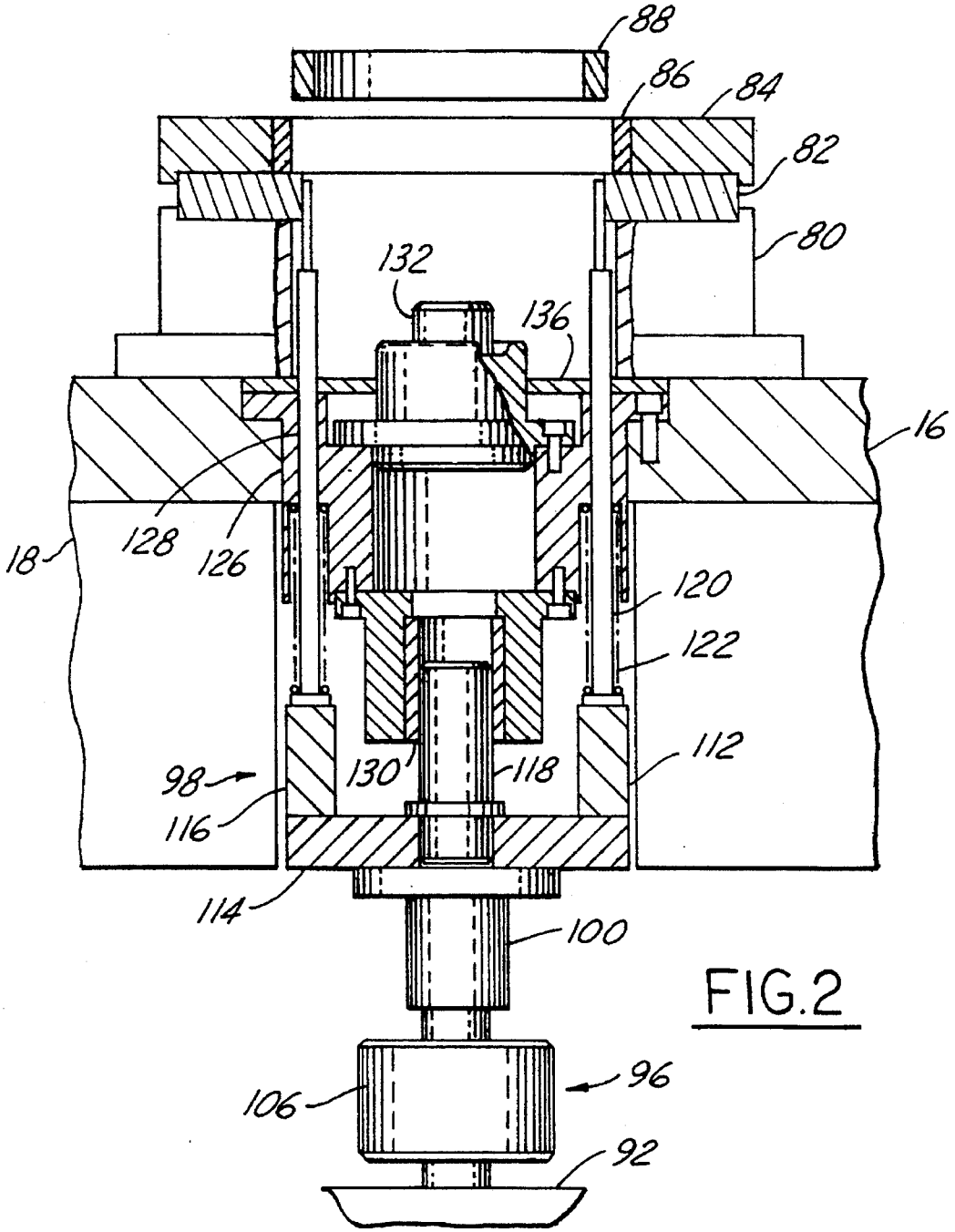
FIG. 2 is an enlarged side view of a portion of the press shown in FIG. 1, including gear ejection equipment and mandrel support.
Figure 3:
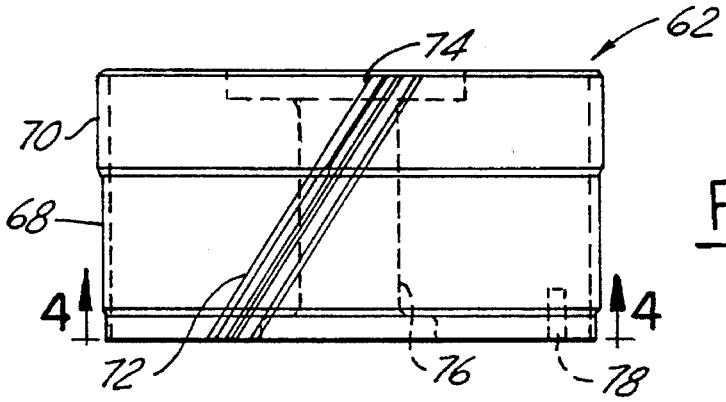
FIG. 3 is a side view of a mandrel as used in the extrusion press of FIG. 1.
Figure 4:
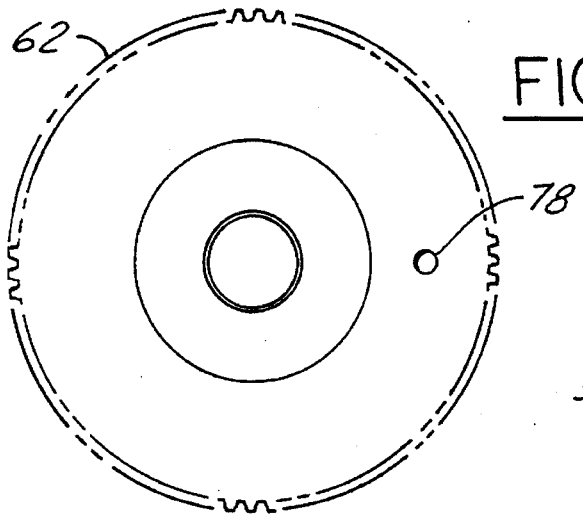
FIG. 4 is a sectional view taken along line 4—4 in FIG. 3.
Figure 6:
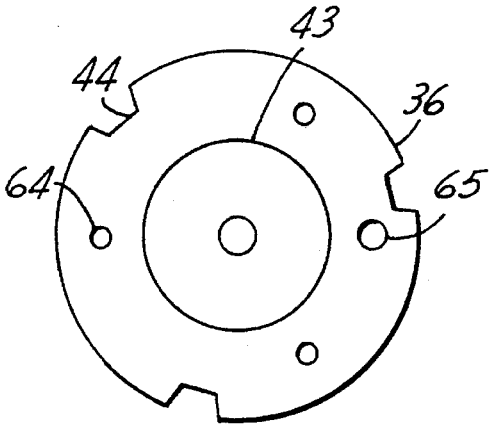
FIG. 6 is a sectional view taken along line 6—6 in FIG. 5.
Figure 5:
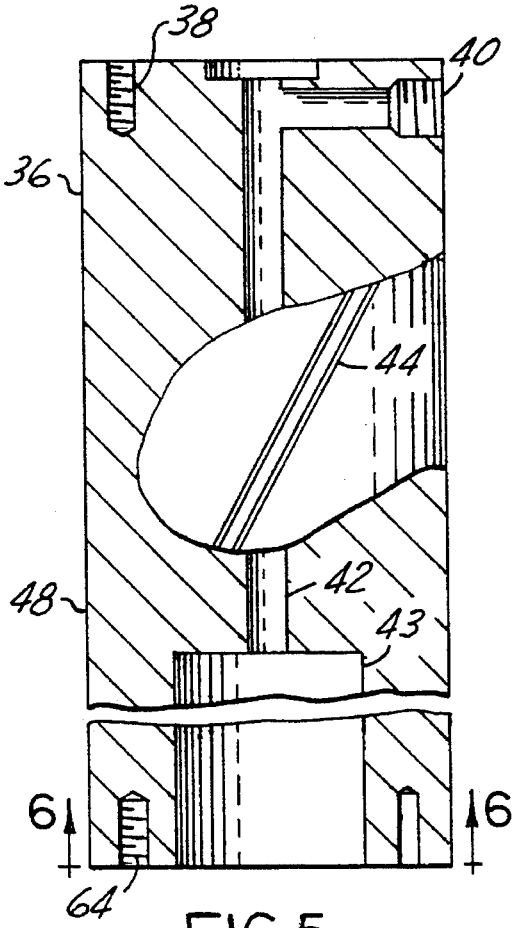
FIG. 5 is a side view of a lead bar as used in the extrusion press of FIG. 1.
Figure 7:
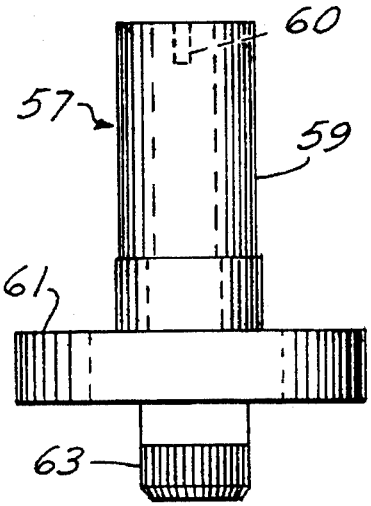
FIG. 7 is a side view of a hydraulic chuck as used in the extrusion press of FIG. 1.
Figure 8:
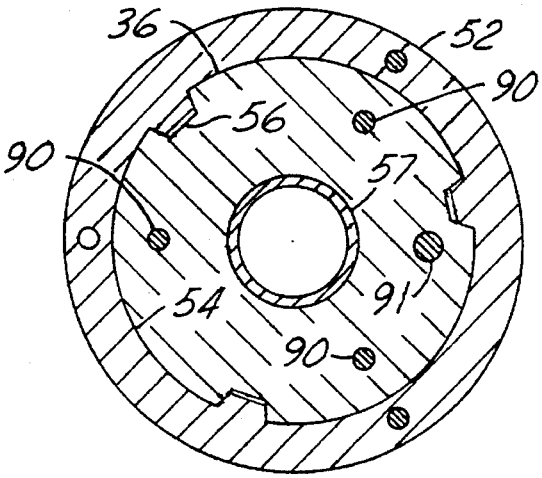
FIG. 8 is a sectional view taken along line 8—8 in FIG. 1.

An extrusion assembly 12 is mounted in a conventional hydraulic press 14. It includes a lower die plate 16, resting on a hydraulic press bed 18 of press 14, and an upper die plate 20, attached to a press member 22 of hydraulic press 14. Die guide posts 24 extend between upper die plate 20 and lower die plate 16. One end of each die guide post 24 is fixed to upper die plate 20. The other end of each die guide post 24 has a ball bearing cage 26 attached to it. Affixed to lower die plate 16 are guide bushings 28, with each guide bushing 28 aligned with one ball bearing cage 26. Ball bearing cages 26 telescopically slide into their respective guide bushings 28 to allow axial movement of upper die plate 20 relative to lower die plate 16 while minimizing friction and maintaining the two parallel to one another.

A retaining clamp ring 30, affixed to upper die plate 20, retains a lead bar plate 32 and a thrust bearing 34, held between lead bar plate 32 and upper die plate 20. A generally cylindrical lead bar 36 extends out from and is affixed to lead bar plate 32 with fasteners 39 inserted in attachment holes 38 in lead bar 36. Lead bar 36 includes a hydraulic receptacle 40 connected to a hydraulic fluid bore 42 running down the center of lead bar 36. Hydraulic receptacle 40 connects to a conventional hydraulic fluid source, not shown, through hydraulic connector 140. Hydraulic fluid bore 42 delivers hydraulic fluid to a chuck cavity 43. Three equally spaced helical grooves 44 run about the periphery of lead bar 36. The helix angle for grooves 44 will be determined such that the die teeth of the mandrel, discussed below, will enter a gear blank at the proper helix angle for the finished gear teeth.

Lead bar outer diameter 48 passes through an opening in a lead nut support member 46, which is generally perpendicular to lead bar 36. Lead nut support 46 is mounted to support posts 49. Support posts 49 are mounted to lower die plate 16 parallel to die guide posts 24. Lead nut support 46 is affixed to support posts 49. Stop posts 50 are mounted on top of lead nut support 46, directly above support posts 49. Stop posts 50 limit the travel of upper die plate 20. A fixed lead nut 52 is bolted to lead nut support 46. Fixed lead nut 52 is a generally ring shaped member with an inner diameter 54 that matches outer diameter 48 of lead bar 36. Three helical protrusions 56 protrude from inner diameter 54. Helical protrusions 56 are sized and spaced to align with and just fit into helical grooves 44 on lead bar 36.

An adjustable lead nut 58 is mounted on lead nut support 46 and also receives lead bar 36, similar to fixed lead nut 52, except that its attachment holes are slightly slotted. Fixed lead nut 52 and adjustable lead nut 58 are initially aligned with one another. As extrusion assembly 12 is cycled many times while forming gears, a small amount of play may begin to occur due to wear between helical protrusions 56 and helical grooves 44. Adjustable lead nut 58, then, can be rotated slightly relative to fixed lead nut 52 so that the play is removed. This will prevent backlash from occurring between lead nuts 52 and 58 and lead bar 36.

A hydraulic chuck 57 includes a lead bar insert portion 59 that just fits within chuck cavity 43, and a hydraulic fluid inlet 60 that aligns with hydraulic fluid bore 42 in lead bar 36. An attachment flange portion 61 is aligned with and fastened to the end of lead bar 36 by a dowel 91, mating with dowel hole 65, and fasteners 90, engaging attachment holes 64 in lead bar 36. A hydraulically controlled chuck teeth member 63 protrudes from attachment flange 61. Chuck teeth member 63 varies its diameter based on the pressure of hydraulic fluid in hydraulic fluid inlet 60. The mechanism for expanding chuck teeth member 63 is a conventional mechanism, the details of which will not be discussed herein.

A stepped mandrel 62 is fastened between a mandrel pilot 144 and a mandrel top 142, by a bolt, not shown, that runs through bore 76 in mandrel 62. This forms a mandrel assembly 67. A dowel hole 78 receives a dowel, not shown, used for alignment purposes. Mandrel top 142 includes internal teeth in a cavity, not shown, that match the teeth on chuck teeth member 63. Mandrel assembly 67 is chucked to the chuck teeth member 63 by inserting chuck teeth member 63 into the cavity in mandrel top 142 and pressurizing the hydraulic fluid to expand chuck teeth member 63. Mandrel pilot 144 includes a bottom rest cavity, not shown, at its lower end for maintaining alignment of mandrel assembly 67 while not attached to chuck 57, as discussed further below.

Stepped mandrel 62 includes a first step 68, including teeth 72, and a second step 70, including teeth 74. First step 68 has a slightly smaller diameter and is concentric with second step 70. A multi-step mandrel is preferred to a single step mandrel if the material to be formed is very hard since this configuration distributes the load more evenly by more gradually forming the material, leading to longer die tooth life. If, however, the ring gears to be formed are made of a soft material, such as aluminum rather than steel, a single step mandrel may be adequate to form the gear teeth. The helix angle of die teeth 72 and 74 is the same as that desired in the finished ring gears.

A load cell 80 is mounted on lower die plate 16. Load cell 80 has force sensors, not shown, mounted within it and is electrically connected to an analyzer, not shown. Load cell 80 will sense the amount of load and torque applied to it during the forming process. If the load and torque is out of a predetermined range, then an operator controlling the press can stop the forming operation and check the equipment for any potential problems. Load cell 80 is optional, and the extrusion process can be conducted without this piece of equipment if so desired.

Mounted on load cell 80 is die base 82. A die shell 84 is mounted on die base 82 and includes a cylindrical central cavity. A ring shaped die insert 86 is fit into the cavity of die shell 84. Die insert 86 is sized to just fit gear blanks 88 within it. It supports gear blanks 88 radially while die base 82 supports them vertically during the forming process. Die shell 84 and die insert 86 are located concentrically with lead bar 36 and stepped mandrel 62.

Ring gear blanks 88 are open ended parts and each includes an annular shell of precise internal diameter in which the internal helical gear teeth will be extruded during the forming process. A ring gear blank 88 is shown, in FIG. 1, just prior to insertion into die insert 86, ready to undergo the gear teeth forming process.

A hydraulic cylinder 92 is mounted at one end to a base 94 of hydraulic press 14 and at the other end to a centering assembly 96. Hydraulic cylinder 92 is connected to a conventional source of hydraulic fluid, not shown, that works to activate cylinder 92 and cause it to raise and lower depending upon the pressure of the fluid.

Centering assembly 96 extends between hydraulic cylinder 92 and an ejection assembly 98. Centering assembly 96 includes a coupling nut 100, mounted under ejection assembly 98. Coupling nut 100 is mounted to an alignment coupler 106. Hydraulic cylinder 92 is mounted to alignment coupler 106 at its other end. Alignment coupler 106 will account for any side to side tolerances in alignment between hydraulic cylinder 92 and coupling nut 100.

Ejection assembly 98 includes an ejector cup 112, made up of a circular ejector plate 114, mounted on coupling nut 100, and an ejector ring 116, protruding from ejector plate 114. An ejector guide pin 118 mounts to ejector plate 114. Mounted on ejector ring 116 are ejector pins 120 that extend almost up to die insert 86, and lie in surface contact with the interior surface of die base 82. Each injector pin 120 has an ejector compression spring 122 mounted about it. The interior cylindrical surface of die base 82 is sized so that it is smaller than the exterior diameter but larger than the interior diameter of gear blank 88. This will allow it to vertically support gear blank 88 during the forming process, but will allow ejector pins 120 to contact the bottom of gear blank 88 during the ejection phase of the process, as discussed below.

A bottom rest assembly 124 is coupled to ejection assembly 98 and mounted in lower die plate 16. Bottom rest assembly 124 includes a rest support member 126, which includes a pair of guide bores 128 that ejector pins 120 extend through, with guide bores 128 each having a wider portion that also receives and retains ejector springs 122. Rest support member 126 also includes a bore for receiving a guide bush 130 that receives ejector guide pin 118, for aligning and guiding ejection assembly 98 relative to bottom rest assembly 124. Bottom rest assembly 124 further includes a bottom chuck 132 mounted thereto, and a ring shaped bottom rest 136 mounted about bottom chuck 132 for receiving mandrel assembly 67 during a portion of the extrusion process.

This overall assembly is used to implement a cold extrusion process for forming internal helical teeth in gear blanks 88, with tight control of lead accuracy and without having to pull mandrel 62 back through a finished gear. The process is a single step backward extrusion process.

A gear blank 88 is inserted into die insert 86. This insertion can be done manually, or by employing a conventional robot if so desired. Hydraulic press member 22 is activated and pushes on upper die plate 20. Upper die plate 20 will move axially toward lower die plate 16, guided by die guide posts 24.

This movement pushes lead bar 36 axially toward gear blank 88. Lead nut support 46, having lead nuts 52 and 58 mounted thereon, is fixed to support posts 49 and does not move axially. Consequently, as lead bar 36 moves axially, helical protrusions 56 on fixed lead nut 52 will engage helical grooves 44 on lead bar 36 and cause lead bar 36 to rotate.

The result of the axial and rotational motion of lead bar 36 will cause die teeth 72 and 74 on mandrel 62 to move forward in a helical motion. Die teeth 72 of first step 68 will engage the inner surface of gear blank 88 and, as they are pressed into gear blank 88, begin to form helical gear teeth thereon. Then, die teeth 74, on second step 70, will begin to engage the inner surface of gear blank 88 and finish forming the helical gear teeth as mandrel 62 is pressed all of the way through blank 88.

When mandrel assembly 67 approaches bottom chuck 132, hydraulic press 22 stops pressing on upper die plate 20, causing mandrel assembly 67 to stop advancing. Hydraulic chuck 57 releases mandrel assembly 67, which will drop over bottom chuck 132 and come to rest on bottom rest 136. Bottom chuck 132 will maintain the alignment of mandrel assembly 67 while bottom rest 136 supports it. Lead bar 36 is retracted without mandrel 62.

The finished ring gear is then removed from die insert 86 by activating hydraulic cylinder 92, which causes ejector pins 120 to lift upward and push the finished gear upward. The finished ring gear is then removed either manually, or with a conventional robot, if so desired. Hydraulic cylinder 92 lowers down to its bottom position while ejector springs 122 cause ejector pins 120 to retract.

Hydraulic press 14 is again activated and pushes lead bar 36 down until chuck teeth member 63 of hydraulic chuck 57 slips into mandrel assembly 67. Hydraulic chuck 57 is activate to expand chuck teeth member 63 to grip mandrel assembly 67. Hydraulic press 14 then lifts upward, pulling lead bar 36 and mandrel assembly 67 with it. Another gear blank 88 is inserted into die insert 86 and the forming process is started over again.

As an alternate embodiment, the bottom chuck can be configured to mount separately from the ejection mechanism in order to lift the mandrel assembly 67 up to chuck 57 to re-attach it, after ejection of the finished part, rather than lead bar 36 lowering down to pick up mandrel assembly 67.

Additionally, as an alternate embodiment, mandrel 62 can be pushed just short of going completely through the part and then retracted, with the part undergoing a facing operation after this to opened up the gear to a through teeth design.

While certain embodiments of the present invention have been described in detail, those familiar with the art to which this invention relates will recognize various alternative designs and embodiments for practicing the invention as defined by the following claims.

We claim:

1. A method of extrusion forming internal helical teeth in a through end gear blank having a bore therethrough comprising the steps of:

providing a die base assembly adapted for receiving and aligning the gear blank;

providing a lead bar concentrically located relative to the die base assembly;

providing an extrusion mandrel assembly having helical die teeth on its external surface;

providing a chuck, coupled to the lead bar, releasably attached to the mandrel assembly;

placing the gear blank in the die base;

moving the mandrel assembly axially into the bore of the gear blank while rotating the mandrel until the mandrel assembly passes through the gear blank so as to extrude internal teeth in the gear blank, thereby forming an internal helical gear;

stopping movement of the mandrel assembly;

releasing the mandrel assembly from the chuck;

pulling the lead bar axially out of the gear;

ejecting the internal helical gear from the die base; and re-attaching the mandrel assembly to the chuck.

2. A method according to claim 1 wherein the re-attaching step comprises:

moving the chuck in the direction of the die base until it contacts the mandrel assembly;

re-attaching the chuck to the mandrel assembly; and moving the chuck and mandrel assembly away from the die base.

3. A method according to claim 1 wherein the re-attaching step comprises:

providing a movable bottom chuck for receiving the mandrel assembly after the mandrel assembly is released from the chuck;

moving the bottom chuck and mandrel assembly in the direction of the chuck until the mandrel assembly contacts the chuck;

re-attaching the mandrel assembly to the chuck; and moving the bottom chuck in the opposite direction.

4. A method according to claim 1 wherein the step of moving the mandrel assembly comprises:

providing a helical guide on the lead bar;

providing a lead nut assembly, selectively fixed relative to the die base, having a helical guide operatively engaging the lead bar; and axially moving the lead bar relative to the lead nut.

5. A method according to claim 1 further comprising:

providing a load cell mounted to the die base;

sensing the load applied to the die base by the mandrel assembly while engaging the gear blank; and ceasing the extrusion forming if the load sensed is outside of a predetermined range.

6. A method according to claim 1 wherein the step of ejecting the internal helical gear comprises:

providing a gear ejection assembly mounted in proximity to the die base assembly, with the gear ejection assembly including gear ejector pins;

moving the ejector pins into contact with the internal helical gear;

pushing the ejector pins against the helical gear with sufficient force to push it out of the die base assembly; and moving the helical gear away from the die base assembly.

7. An apparatus for extrusion forming internal helical teeth in a through end gear blank comprising:

a press, including a first member and a base, with the first member coupled to and axially movable relative to the base;

a lead bar coupled to the first member having an outer surface which includes helical guides;

a mandrel assembly having an outer surface which includes helical die teeth for forming the internal helical teeth;

a chuck means coupled to the lead bar for removably coupling the mandrel assembly to the chuck means;

a lead nut assembly mounted to the press having helical guides operatively engaging the helical guides on the lead bar;

a die mounted to the base including a cavity concentrically located relative to the mandrel assembly and adapted to receive the gear blank;

means for receiving the mandrel assembly when it is not coupled to the chuck; and ejection means for ejecting the gear blank from the die.

8. An apparatus according to claim 7 wherein the helical die teeth of the mandrel assembly comprise more than one set of teeth, with each set of teeth having a different diameter.

9. An apparatus according to claim 7 wherein the die comprises a die base mounted to the press base, a die shell mounted to the die base having a generally cylindrical cavity, and a ring shaped die insert received within the die base cylindrical cavity.

10. An apparatus according to claim 9 wherein the die further comprises a load cell mounted between the die base and the press base.

11. An apparatus according to claim 7 further including a plurality of guide bushings affixed to the base of the press and a plurality of die guide posts, each having a first and a second end, with the first end of each affixed to the first member of the press in alignment with its respective one of the guide bushings, and including ball bearing cages affixed to the second end of each guide post telescopically mounted within its respective guide bushing.

12. An apparatus according to claim 7 wherein the lead nut assembly comprises a lead nut support plate selectively fixed relative to the press base, a fixed nut coupled to the lead nut support plate and an adjustable lead nut coupled to the lead nut support plate, with the fixed and the adjustable lead nuts operatively engaging the lead bar.

13. An apparatus according to claim 7 wherein the mandrel assembly includes a cavity having internal teeth and the chuck includes chuck teeth member that fits within and removably secures itself to the mandrel internal teeth.

14. An apparatus according to claim 7 wherein the helical guide on the lead bar comprises helical grooves and the helical guide on the lead nut assembly comprises helical protrusions received within the helical grooves.

15. An apparatus according to claim 14 wherein the helical die teeth of the mandrel comprise more than one set of teeth, with each set of teeth having a different diameter.

16. An apparatus according to claim 7 wherein the means for receiving the mandrel assembly comprises a bottom chuck for maintaining alignment of the mandrel assembly relative to the chuck when the two are not attached and a bottom rest for supporting the mandrel assembly while the mandrel assembly is not attached to the chuck.

17. An apparatus according to claim 7 wherein the ejection means comprises a plurality of ejector pins mounted in proximity to and protruding partially through the die in proximity to the gear blank when installed in the die, and a means for pushing the ejector pins into contact with the gear blank such that the gear blank will be pushed out of the die.

18. An apparatus according to claim 7 wherein the mandrel assembly comprises a mandrel pilot, a mandrel top and a mandrel affixed between the two, with the mandrel top removably coupled to the chuck means and the mandrel pilot is received by the means for receiving the mandrel assembly.

* * * * *